US007832852B2

(12) United States Patent
Leighton et al.

(10) Patent No.: US 7,832,852 B2
(45) Date of Patent: Nov. 16, 2010

(54) CONTINUOUS MEDIA WEB HEATER

(75) Inventors: Roger G. Leighton, Rochester, NY (US); Paul John McConville, Webster, NY (US); Vincent M. Williams, Palmyra, NY (US)

(73) Assignee: Xerox Corporation, Norwalk, CT (US)

( * ) Notice: Subject to any disclaimer, the term of this patent is extended or adjusted under 35 U.S.C. 154(b) by 749 days.

(21) Appl. No.: 11/879,113

(22) Filed: Jul. 16, 2007

(65) Prior Publication Data

US 2009/0021550 A1 Jan. 22, 2009

(51) Int. Cl.
*B41J 29/38* (2006.01)
*B41J 2/01* (2006.01)

(52) U.S. Cl. ..... 347/102; 347/17

(58) Field of Classification Search ..... 347/17, 347/102, 104; 392/407–440
See application file for complete search history.

(56) References Cited

U.S. PATENT DOCUMENTS 4,435,637 A 3/1984 DeVries
4,509,270 A 4/1985 Stephansen
5,526,108 A 6/1996 Billet et al.
5,778,145 A 7/1998 De Nichilo
6,306,336 B1 * 10/2001 Hrezo et al. ..... 266/92

FOREIGN PATENT DOCUMENTS

JP 2009018582 A * 1/2009

* cited by examiner

*Primary Examiner*—Daniel Petkovsek
(74) *Attorney, Agent, or Firm*—Maginot, Moore & Beck LLP

(57) ABSTRACT

A radiant heating comprises a housing having an opening for positioning adjacent a media web in an imaging device. A pair of radiant heating panels is positionable in the housing to any one of a plurality of positions between and including a fully open position in which the pair of radiant heating panels are positioned side by side in the opening of the housing and facing the media web and a retracted position in which the pair of radiant heating panels are inside the housing and facing each other. The radiant panels are configured to emit thermal radiation in accordance with a variable thermal output signal. A panel driver is operably coupled to the pair of radiant heating panels for positioning the pair of radiant heating panels to at least one of the plurality of positions in response to a variable view factor signal.

18 Claims, 5 Drawing Sheets

CONTINUOUS MEDIA WEB HEATER

TECHNICAL FIELD

This disclosure relates generally to imaging devices that generate images on a continuous web of media, and, more particularly, to heaters used to thermally condition the continuous web of media before fixing the images to the web.

BACKGROUND

In general, ink jet printing machines or printers include at least one printhead unit that ejects drops or jets of liquid ink onto a recording or image forming media. A phase change ink jet printer employs phase change inks that are in the solid phase at ambient temperature, but transition to a liquid phase at an elevated temperature. The molten ink can then be ejected as drops or jets by a mounted printhead unit onto a printing media at the elevated operating temperature of the machine or printer. The ink can be ejected directly onto an image receiving substrate, or indirectly onto an intermediate imaging member before the image is transferred to an image receiving substrate. Once the ejected ink is on the image receiving substrate, the ink droplets quickly solidify to form an image.

In both the direct and offset printing architecture, images may be formed on a media sheet or a media web. A media sheet printer typically includes a supply drawer that houses a stack of media sheets. A feeder removes a sheet or media from the supply and delivers it into a feed path that directs the sheet past a print head so the print head ejects ink directly onto the sheet. In other types of sheet printers, a media sheet in the feed path is pressed into contact with a rotating intermediate member that bears ink, which has been ejected onto the member by one or more print heads.

In a web printer, a continuous supply of media, typically provided in a media roll, is mounted onto rollers that are driven by motors. A loose end of the media web is passed through a print zone opposite the print head or heads of the printer. Beyond the print zone, the media web is gripped and pulled by mechanical structures so a portion of the media web continuously moves through the print zone. Tension bars or rollers may be placed in the feed path of the moving web to remove slack from the web so it remains taut without breaking.

Regardless of the type of media, efficient transfer of a marking material to the recording media is enhanced by heating the media prior to printing an image onto the web and fixing the image onto the web. In web-fed printers, media heaters typically comprise one or more radiant heaters positioned along the media pathway for imparting a desired amount of thermal energy to the moving web. Thermal output of the radiant heaters is controlled by adjusting the power supplied to the heaters. The printing system typically includes a thermal sensor positioned adjacent the media pathway to detect the temperature of the moving web and provide the detected temperatures to a controller. The controller may then adjust the power provided to heating panels as necessary in accordance with the detected temperatures of the web in order to heat the media web to a desired temperature.

One difficulty faced by these previously known media heaters is heating the moving media web to a substantially consistent, or uniform, temperature that is selected to promote adherence of the melted ink to the recording media, to minimize "show through" of the ink through the web, and to maximize ink dot spread. Due to the thermal mass of the radiant heaters, temperature changes in the heaters in response to power adjustments may take a relatively long time to take affect. The media web, however, may be moved through the printing system at relatively fast speeds, e.g. 70 inches/second or more. Consequently, if the detected temperature of the moving web changes, the thermal output of the radiant panels may not be able to change fast enough to compensate, resulting in non-uniform heating of the media.

Non-uniform heating of the media may result in portions of the web being heated to temperatures that are above or below the selected heating temperature. If the recording media is heated to a temperature that is too low, the ink may freeze after a short distance of penetration into the media producing raised ink droplets and images with an embossed characteristic. Such ink droplets or images may have poor adhesion or may easily be scraped off or flake off by action of folding or creasing or may be subject to smearing or offsetting to other sheets. If the media is heated to a temperature that is too high, the size of the ink spot from each drop will vary depending on the characteristics of the media and, in some cases, the ink may not solidify before it has penetrated completely through the paper, resulting in a defective condition called "show through".

SUMMARY

In order to address the issues associated with the prior art, a radiant heating unit has been developed for enabling faster temperature adjustments for heating a moving web which does not require changing the heater setpoint temperature. In one embodiment, the radiant heating unit comprises a housing having an opening for positioning adjacent a media web in an imaging device, and a pair of radiant heating panels configured to emit thermal radiation in accordance with a variable thermal output signal. The pair of panels are positionable in the housing to any one of a plurality of positions between and including a fully open position in which the pair of radiant heating panels are positioned side by side in the opening of the housing and facing the media web and a retracted position in which the pair of radiant heating panels are inside the housing and facing each other. A view factor of the pair of panels with respect to the media web is different for each position in the plurality of positions. The radiant heating unit includes a panel driver operably coupled to the pair of radiant heating panels for positioning the pair of radiant heating panels to at least one of the plurality of positions in response to a variable view factor signal.

In another embodiment, a web heating system for heating a continuous media web in an imaging device comprises a plurality of radiant heating units positioned adjacent a media pathway of a continuous media web in an imaging device. Each radiant heating unit includes a housing having an opening for positioning adjacent the media web and a pair of radiant heating panels configured to emit thermal radiation in accordance with a variable thermal output signal. The pair of panels is positionable in the housing to any one of a plurality of positions between and including a fully open position in which the pair of radiant heating panels are positioned side by side in the opening of the housing and facing the media web and a retracted position in which the pair of radiant heating panels are inside the housing and facing each other to prevent heating the web above 300 C ignition temperature when the web is not moving. A view factor of the pair of panels with respect to the media web is different for each position in the plurality of positions. Each radiant heating unit includes a panel actuator driver operably coupled to the pair of radiant heating panels for positioning the pair of radiant heating panels to at least one of the plurality of positions in response to a variable view factor signal. The system includes at least one temperature sensor for detecting a temperature of the media web and for generating a temperature signal indicative of the detected temperature of the media web. A web heating controller is configured to selectively generate thermal output signals and view factor signals for each radiant heating unit in the plurality of radiant heating units. The web heating controller is configured to generate at least one of the thermal output signals and change the view factor in accordance with the temperature signal.

In yet another embodiment, a solid ink imaging device comprises a continuous media web and a media handling system for transporting the media web along a media pathway through a solid ink imaging device. The system includes a solid ink printing system positioned along the media pathway for printing images on the media web. A web heating system is positioned along the media pathway upstream from the printing system for heating the media web to a web heating temperature. The web heating system comprises at least one radiant heating unit positioned adjacent the media pathway. The at least one radiant heating unit includes a housing having an opening for positioning adjacent the media web and a pair of radiant heating panels configured to emit thermal radiation in accordance with a variable thermal output signal. The pair of panels is positionable in the housing to any one of a plurality of positions between and including a fully open position in which the pair of radiant heating panels are positioned side by side in the opening of the housing and facing the media web and a retracted position in which the pair of radiant heating panels are inside the housing and facing each other. A panel driver is operably coupled to the pair of radiant heating panels for positioning the pair of radiant heating panels to at least one of the plurality of positions in response to a variable view factor signal. The device includes at least one temperature sensor for detecting a temperature of the media web and for generating a temperature signal indicative of the detected temperature of the media web. A web heating controller selectively generates thermal output signals and view factor signals for at least one radiant heating unit to heat the media web to the web heating temperature. The web heating controller is configured to generate at least one of the thermal output signals and the view factor signals in accordance with the temperature signal.

BRIEF DESCRIPTION OF THE DRAWINGS

The foregoing aspects and other features of the radiant heating unit and web heating systems incorporating radiant heating units are explained in the following description, taken in connection with the accompanying drawings, wherein.

DETAILED DESCRIPTION

Figure 1:
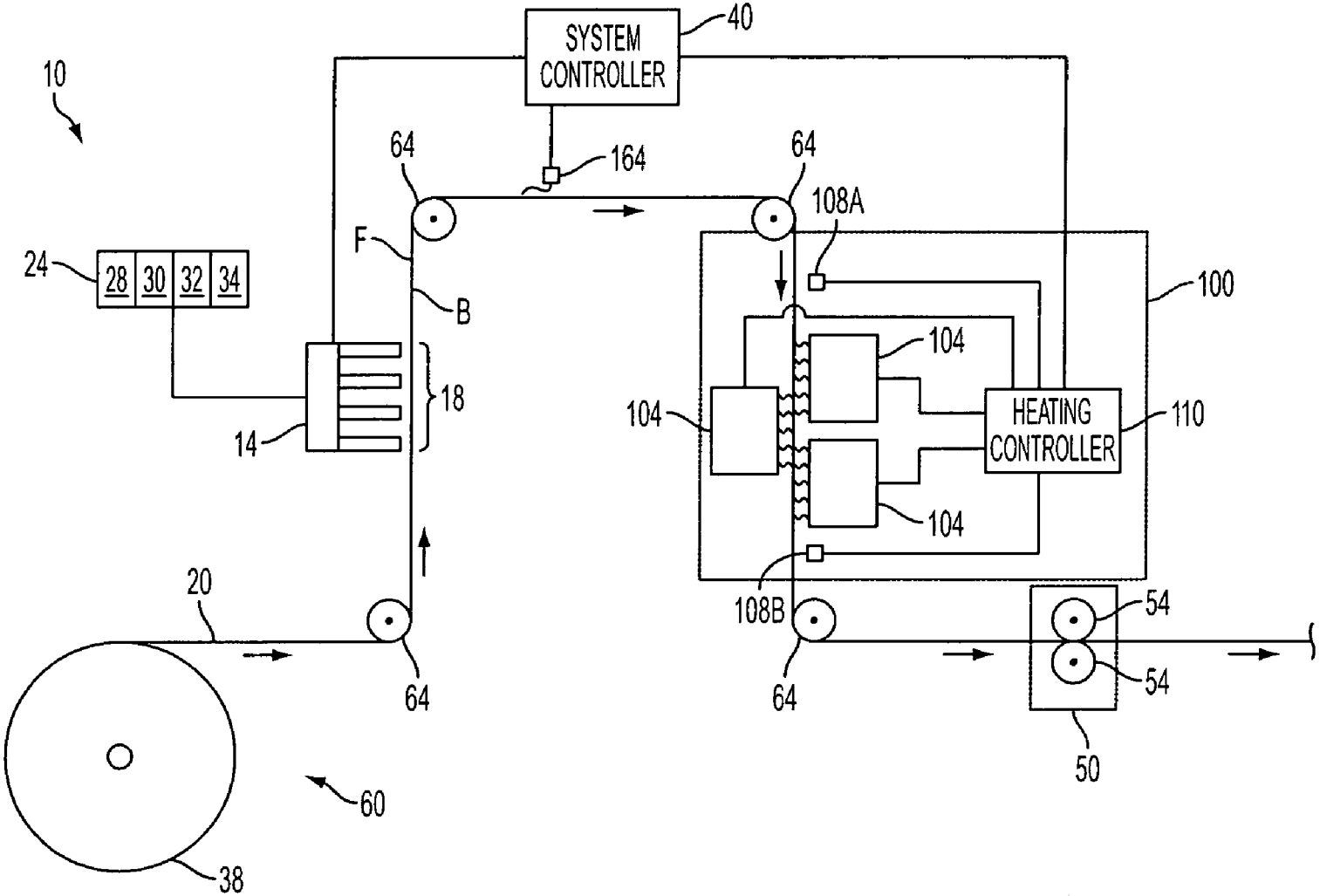
FIG. 1 is a block diagram of a phase change imaging device for printing onto a continuous media web.

For a general understanding of the present embodiments, reference is made to the drawings. In the drawings, like reference numerals have been used throughout to designate like elements.

FIG. 1 schematically illustrates an imaging apparatus, or at least a portion of an imaging apparatus, 10 in which the elements pertinent to the present disclosure are shown. In the embodiment shown, the imaging apparatus 10 implements a solid ink print process for printing onto a continuous media web. To this end, the imaging device 10 includes a web supply and handling system, a phase change ink printing system, and a web heating system. Although the web heating system is described for use in a phase change ink imaging device, the web heating system may be useful in any of a variety of other imaging apparatus, including for example, laser printers, facsimile machines, copiers, or any other imaging apparatus capable of applying one or more colorants to a continuous web of media.

As shown in FIG. 1, the phase change ink printing system includes a web supply and handling system 60, a printhead assembly 14, a fixing assembly 50 and a web heating system 100. The web supply and handling system 60 may include one or more media supply rolls 38 for supplying a media web 20 to the imaging device. The supply and handling system is configured to feed the media web in a known manner along a media pathway in the imaging device through the print zone 18, and past the web heating system 100, and fixing assembly 50. To this end, the supply and handling system may include any suitable device 64 such as drive rollers, idler rollers, tensioning bars, etc. for moving the media web through the imaging device. The system may include a take-up roll (not shown) for receiving the media web 20 after printing operations have been performed. Alternatively, the media web 20 may be fed to a cutting device (not shown) as is known in the art for cutting the media web into discrete sheets.

The printhead assembly 14 is appropriately supported to emit drops of ink directly onto the media web 20 as the web moves through the print zone 18. In alternative embodiments, the printhead assembly 14 may be configured to emit drops onto an intermediate transfer member (not shown), such as a drum or belt, for subsequent transfer to the media web. The printhead assembly 14 may be incorporated into either a carriage type printer, a partial width array type printer, or a page-width type printer, and may include one or more printheads. As illustrated, the printhead assembly includes four page-width printheads for printing full color images comprised of the colors cyan, magenta, yellow, and black.

Ink is supplied to the printhead assembly from the solid ink supply 24. Since the phase change ink imaging device 10 is a multicolor device, the ink supply 24 includes four sources 28, 30, 32, 34, representing four different colors CYMK (cyan, yellow, magenta, black) of phase change ink solid ink. The phase change ink system 24 also includes a solid phase change ink melting and control assembly or apparatus (not shown) for melting or phase changing the solid form of the phase change ink into a liquid form, and then supplying the liquid ink to the printhead assembly 14.

Once the drops of ink have been emitted by the printhead assembly onto the moving web to form an image, the web is moved through a fixing assembly 50 for fixing the emitted ink drops, or image, to the web. In the embodiment of FIG. 1, the fixing assembly 50 comprises at least one pair of fixing rollers 54 that are positioned in relation to each other to form a nip through which the media web is fed. The ink drops on the media web are pressed into the web and spread out on the web by the pressure formed by the nip. Although the fixing assembly 50 is depicted as a pair of fixing rollers, the fixing assembly may be any suitable type of device or apparatus, as is known in the art, which is capable of fixing the image to the web.

Operation and control of the various subsystems, components and functions of the device 10 are performed with the aid of a controller 40. The controller 40 may be implemented as hardware, software, firmware or any combination thereof. In one embodiment, the controller 40 comprises a self-contained, microcomputer having a central processor unit (not shown) and electronic storage (not shown). The electronic storage may store data necessary for the controller such as, for example, the image data, component control protocols, etc. The electronic storage may be a non-volatile memory such as a read only memory (ROM) or a programmable non-volatile memory such as an EEPROM or flash memory. Of course, the electronic storage may be incorporated into the ink jet printer, or may be externally located. The controller 100 is configured to orchestrate the production of printed or rendered images in accordance with image data received from the image data source (not shown). The image data source may be any one of a number of different sources, such as a scanner, a digital copier, a facsimile device, etc. Pixel placement control is exercised relative to the media web 20 in accordance with the print data, thus, forming desired images per the print data as the media web is moved through the print zone.

The web heating system 100 comprises one or more radiant heating units 104 for emitting thermal radiation onto the web 20. The media web is heated by absorbing the thermal radiation emitted from the units 104 at a color temperature suitable for the heating of the chosen media type (2.5-3.0 μm for paper ~400 C surface temperature). The web may also be heated to some degree by convection of the hot air between the heating units and the web. Radiant heating units 104 may be positioned anywhere along the media pathway for emitting thermal radiation toward the media web. In the embodiment of FIG. 1, radiant heating units 104 are positioned downstream from the printhead assembly 14 in order to heat the media web 20 prior to fixing the image to the web at the fixing assembly 50, otherwise known as mid-heating. In other embodiments, radiant heating units 104 may also be positioned to heat the media web prior to reaching the print zone (preheating) and/or downstream from the printhead assembly (post-heating). There may be any suitable number of radiant heating units employed. In the depicted embodiment, the web heating system 100 includes three radiant heating units 104 positioned upstream from the printhead assembly in order to preheat the media web prior to printing with two radiant heating units successively positioned to heat a front side F of the media web 20, and another radiant heating unit positioned to heat the back side B of the media web.

The web heating system 100 may be configured to heat the media web to any suitable temperature dependant upon a number of factors including web speed, web type, ink type, position along the media pathway, etc. For example, when heating the media web, the web heating system may be configured to heat the media web to approximately 65 to 70 degrees C. prior to printing. The web heating system may include one or more noncontact IR temperature sensors 108 as are known in the art for measuring the temperature of the moving web 20 at one or more locations associated with the web. Temperature sensors 108 may non-contact type sensors such as thermopile or similar IR sensor. In one embodiment, a temperature sensor 108A is provided along the media pathway just upstream from the radiant heating units 104 of the web heating system to detect the temperature of the web prior to passing by the radiant heating units. Another temperature sensor 108B may also be provided along the media pathway downstream from the radiant heating units 104 to detect the temperature of the web after being heated by the heating units. In any case, the temperature sensors 108 are operable to relay signals indicative of the one or more measured temperatures to the web heating controller 110. Thus knowing temperatures before and after the heating unit will let the controller know how much to change the view factor angle on the fly to control the exit paper temperature accurately.

As described above, previously known web heating systems typically adjusted the heat applied to a media web by varying the power supplied to the heaters in accordance with a detected temperature of the media web. Because it may take a relatively significant amount of time for the thermal output of radiant heaters to change in response to power adjustments to the panels, the web heating system 100 of the present disclosure includes a dual gain control system in which thermal output of the panels is controlled by adjusting the power to the panels (low gain control) and the amount of thermal radiation that reaches the media web from the panels is controlled by varying the view factor of the panels relative to the media web (high gain control). As described below, the view factor of the radiant panels to the web may be varied by adjusting the distance, angle and/or orientation of the panels of a heating unit with respect to the media web. View factor adjustments, thus, involve physical movement of the panels with respect to the media web. Therefore, depending on the method of moving the panels, view factor adjustments may be performed relatively quickly which facilitates rapid adjustments of the amount of thermal radiation that reaches the media web.

Figure 2:
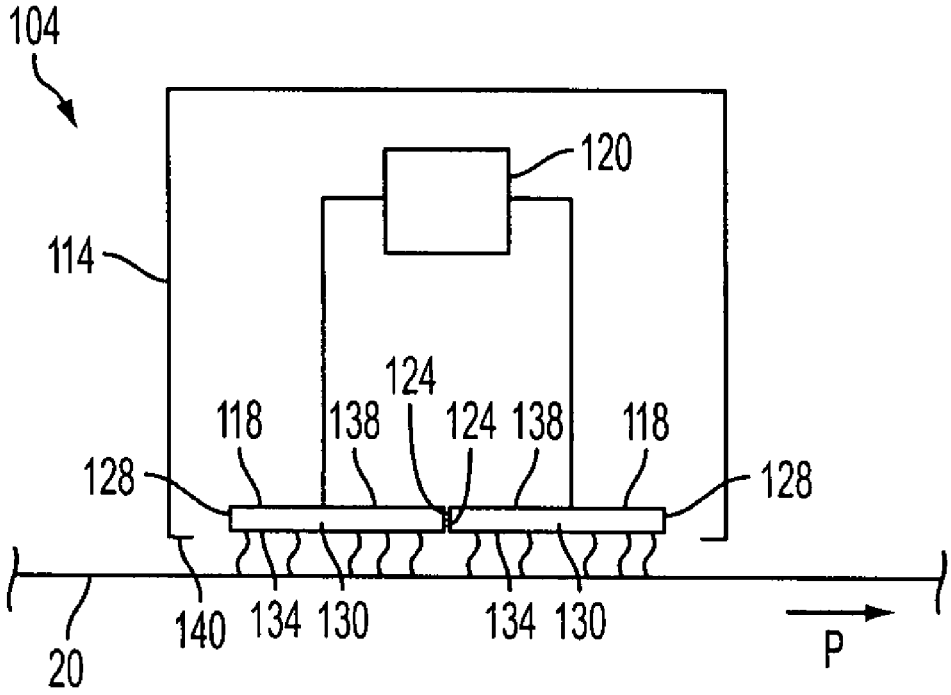
FIG. 2 is a block diagram of a side view of a radiant heating unit of the imaging device of FIG. 1 shown in the fully open position.
Figure 3:
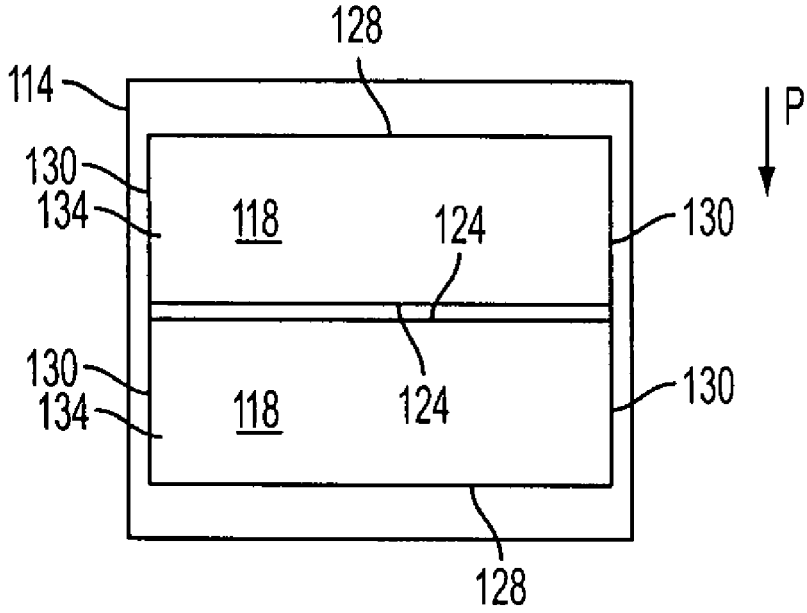
FIG. 3 is a front view of the radiant heating unit of FIG. 2.

Referring now to FIG. 2, a block diagram of an exemplary radiant heating unit 104 is shown arranged adjacent a media web 20. Each radiant heating unit 104 includes a housing 114, a pair of radiant heating panels 118, and a panel driver assembly 120. As shown in FIGS. 2 and 3, each radiant heating panel includes an inboard edge 124, an outboard edge 128, a pair of lateral ends 130, a front surface 134 and a back side 138. Thermal radiation is emitted from the panels through the front surface 134 of the panels 118. As is known in the art, the housing 114 of the radiant heating units as well as the non-emitting surfaces 124, 128, 130, 138 of the radiant heating panels 118 may be thermally insulated. The panels have a width between the lateral ends 130 that is sized to span the width of the media web 20. The housing includes an opening 140 on one side for positioning adjacent the media pathway of the web 20. The opening 140 is sized so that the panels 118 may be positioned side by side in the opening of the housing with the inboard edges 124 adjacent each other, and with the front surfaces 134 coplanar and facing the web 20.

The development of thermal energy in the heating panels 118 may be accomplished in any suitable manner. For example, heat may be generated in a heating panel by a resistance heating element. Alternatively, a heating panel may include one or more heating lamps such as quartz, carbon filament or halogen lamps mounted between a ceramic backing and a protective quartz plate (front side). In any case, the panels 118 are configured to emit thermal radiation in accordance with an electrical current provided by one or more heater power supplies (not shown). As described below, the web heating controller 110 is operable to control the amount of electrical current supplied to the heating panels via the power supply.

Each radiant heating unit 104 includes a panel driver assembly 120 operably coupled to the radiant panels 118 to vary the view factor of the radiant panels 118 of the heating unit with respect to the web 20. As used herein, view factor is defined as the ratio of the thermal energy emitted by a radiant heating unit 104 that is intercepted by the media web to the total amount of thermal energy emitted by a radiant heating unit 104. The panel driver assembly is configured to vary the view factor of a radiant heating unit in order to control the amount of thermal radiation that reaches, or is intercepted by, the media web.

Figure 4:
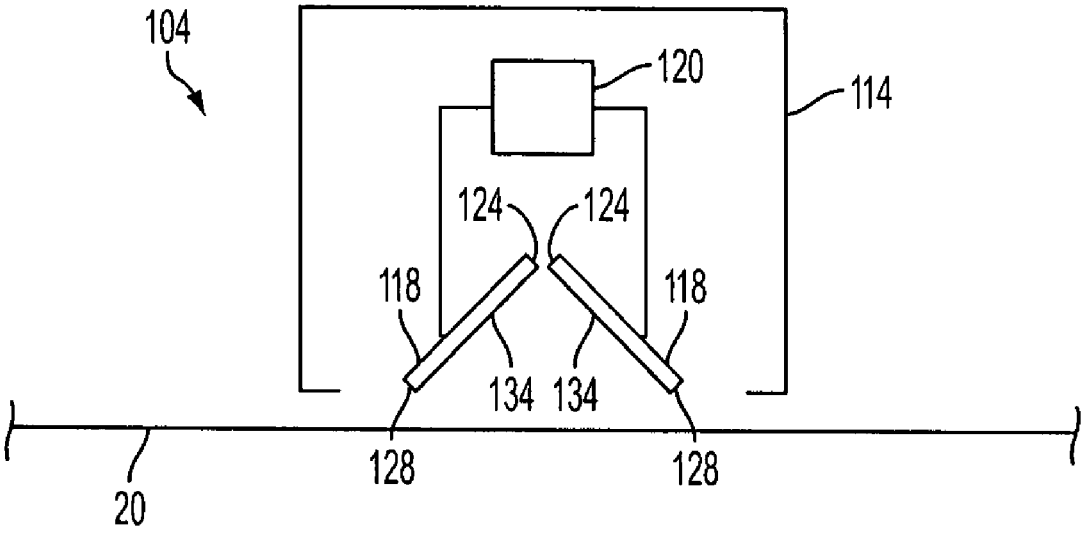
FIG. 4 is a block diagram of a side view of a radiant heating unit of the imaging device of FIG. 1 shown at a mid-position.
Figure 5:
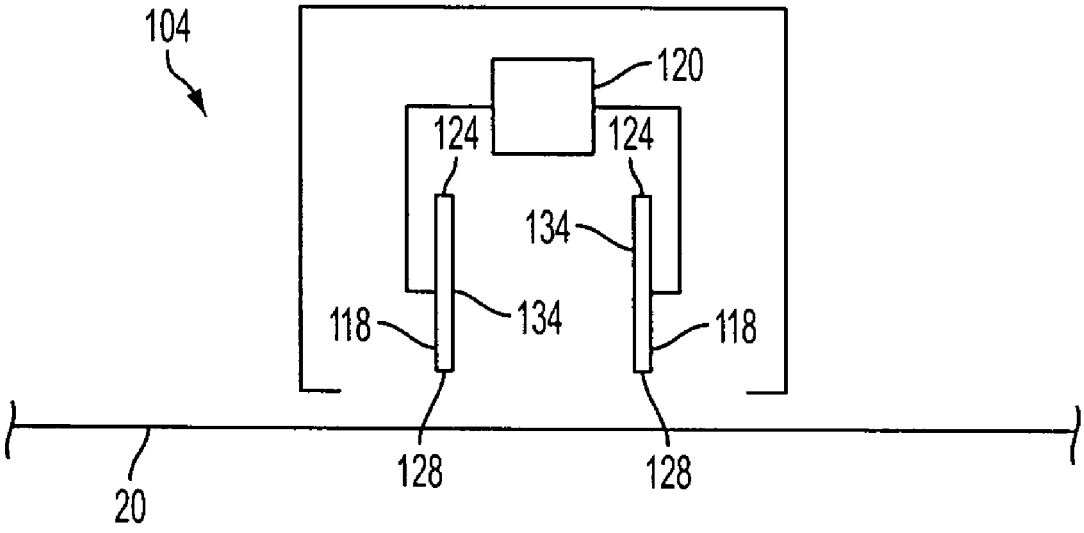
FIG. 5 is a block diagram of a side view of a radiant heating unit of the imaging device of FIG. 1 shown in the retracted position.

As shown in FIGS. 2, 4 and 5, the panel driver assembly 120 is operably coupled to the radiant heating panels of a heating unit to selectively move the panels between a fully open position (See. FIG. 2) in which the panels 118 are each facing the web 20 at the opening of the housing and a retracted position (See FIG. 5) in which the panels 118 are pivoted and/or rotated into the housing 114 so that they are substantially perpendicular to the media web 20 and facing each other which cancels the radiative load to the media. A small convective load is applied to the web but at a safe temperature. The panel driver assembly 120 is configured to position the panels 118 at any point in between the fully open and retracted positions. For example, FIG. 4 shows the panels at a mid-position between the fully open and retracted positions. As the panels 118 are moved between the fully open position and the retracted position, the angle of the panels with respect to the media web and, hence, the distance of the inboard portions 124 of the panels changes thereby altering the amount or intensity of thermal radiation that reaches the media web.

Figure 6:
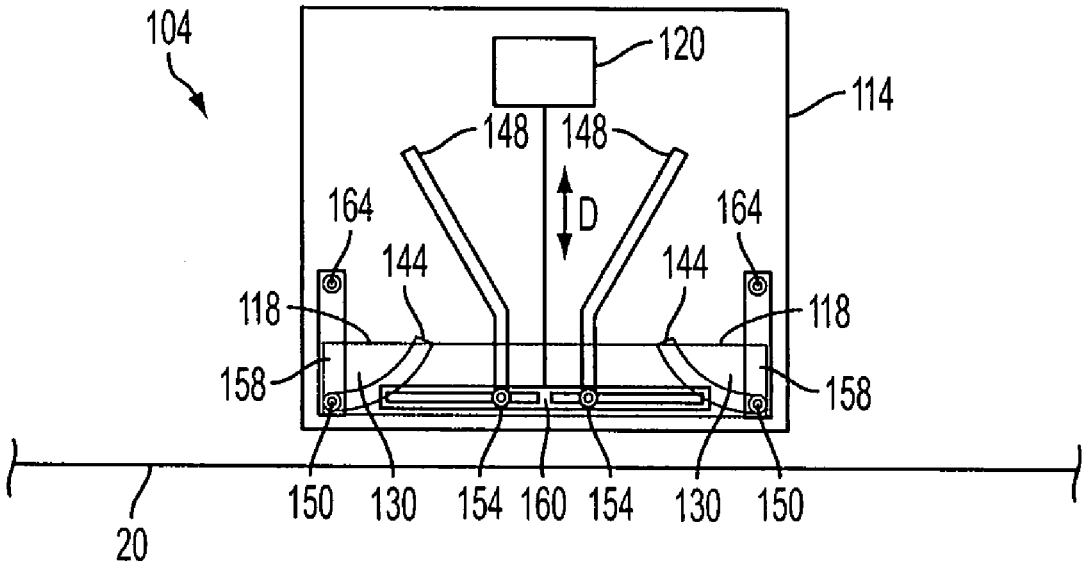
FIG. 6 is another block diagram of side view of a radiant heating unit of the imaging device of FIG. 1 shown in the fully open position.
Figure 7:
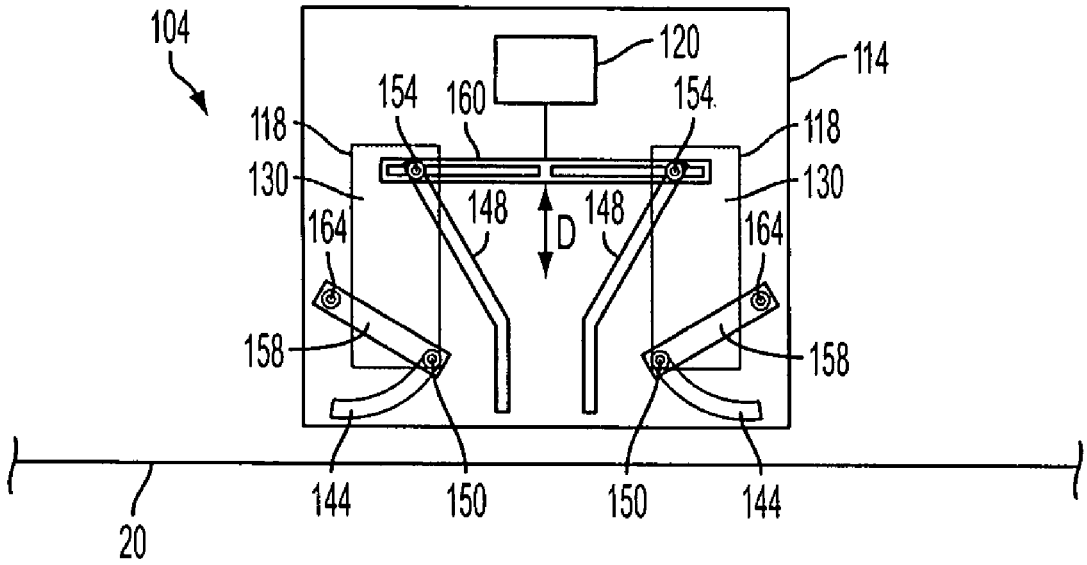
FIG. 7 is another block diagram of a side view of a radiant heating unit of the imaging device of FIG. 1 shown in the retracted position.
Figure 8:
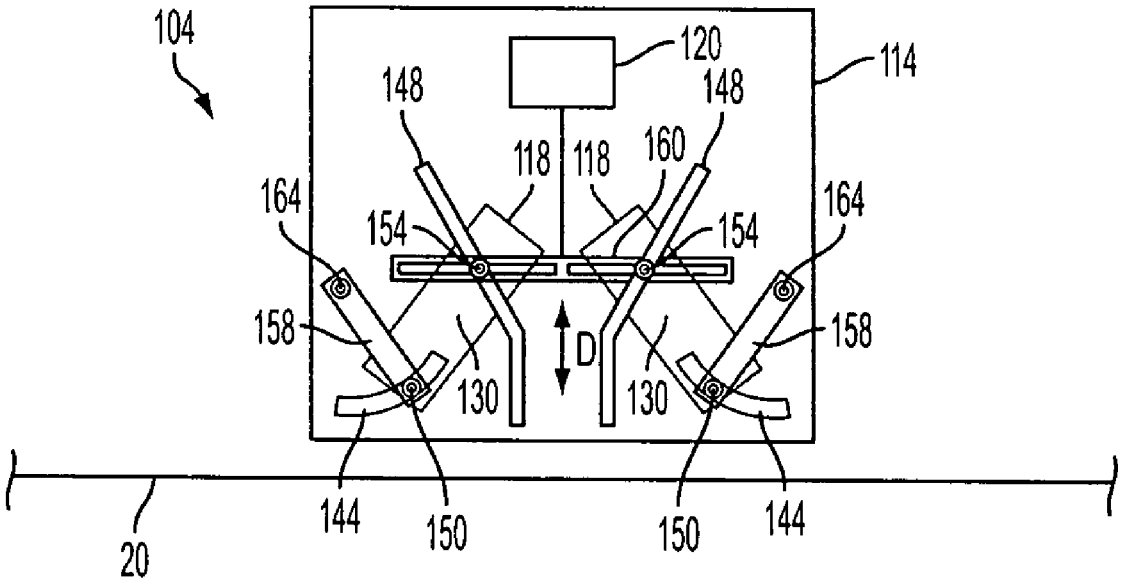
FIG. 8 is another block diagram of a side view of a radiant heating unit of the imaging device of FIG. 1 shown at a mid-position.

The panel driver assembly 120 may be configured to move the panels between the fully open and retracted positions in a variety of ways. Referring to FIGS. 6-8, in one embodiment, the housing 114 includes guide slots 144, 148 that are configured to interact with projections 150, 154 extending from at least one of the lateral sides 130 of each of the radiant panels. In the illustrated embodiments, the radiant panels 118 each include a projection 150 extending from at least one of the lateral sides of the panel adjacent the outboard edge and a projection 154 extending from at least one of the lateral sides 130 of the panel adjacent the inboard edge. The panel projections 150 adjacent the outboard edges of the panels extend through the outboard guide slots 144 on the housing and are operably connected to a rotating pivot link 158. The panel projections 154 adjacent the inboard edges extend through the inboard guide slots on the housing and are rotatably and slidably received in a sliding drive link 160. In this embodiment, linear motion of the drive link 160 away from or towards the front of the housing 114 (shown by directional arrow D) causes the inboard projections 154 on the panels to move along the inboard guide slots 148, and, at the same time, causes the pivot link 158 to pivot around pivot point 164 so that the outboard projections slide along the outboard guide slots. Thus, linear movement of the drive link causes the panels to be moved from the fully open position as shown in FIG. 6 to the retracted position as shown in FIG. 7, or to any position therebetween such as the mid-position shown in FIG. 8.

In the embodiment of FIGS. 6-8, the panel driver assembly 120 is operably coupled to the drive link 160 in order to linearly drive the drive link 160 along a drive path which corresponds to the path of the drive link as the panels are moved between the fully open position and the retracted position. The panel driver assembly 120 may comprise any suitable type driving unit that is capable of linearly driving the drive link such as an electric motor/lead screw, multi-position air cylinder and the like, as well as their respective motion transmission accessories (not shown). According to one embodiment, the panel driver assembly 120 may include a position sensing device (not shown) that is configured to detect a linear position of the drive link along the drive path. Such position sensors are known in the art. The linear position sensor is configured to generate a signal indicative of the linear position of the drive link which may then be fed back to the web heating controller, thus providing a closed-loop feedback control regarding the position, or view factor, of the radiant heating panels.

The web heating controller may be implemented as hardware, software, firmware or any combination thereof. In addition, the web heating controller may be a standalone controller or may be incorporated into the system controller. The web heating controller 110 is operable to control the thermal radiation emitted by the radiant panels 104, as well as the view factor of the panels with respect to the media web based, at least in part, on the measured temperature of the media web. The web heating controller 110 may be configured to control the radiant heating units 104 as a group in which each unit is configured to have the same thermal output and the same view factor. Alternatively, the web heating controller 110 may be configured to control each radiant heating unit 104 individually so that the thermal output and the view factor of each radiant heating unit are separately adjustable.

The web heating controller 110 is configured to generate one or more control signals to implement feedback control for heating the media web 20. The control signals may comprise, for example, power control signals to the power supplies to control the thermal output of the radiant units, and linear-motion drive signals to the panel drive assemblies to control the linear movement of the drive links in order to vary the view factors.

In operation, the web heating controller 110 is configured to set the thermal output and the view factor of the one or more radiant heating units to an initial level that is predetermined to heat the media web to a media heating temperature. In one embodiment, the initial view factor of the one or more radiant heating panels may be selected such that the panels are positioned at a mid-position between the fully open and retracted position. This positioning allows position adjustments from the selected mid-position toward the fully open position to cause a corresponding increase in the amount of the thermal radiation that reaches the web, and, consequently, an increase in the temperature of the web. Similarly, this positioning allows position adjustments from the selected mid-position toward the retracted position to cause a corresponding decrease in the amount of the thermal radiation that reaches the web, and, consequently, a decrease in the temperature of the web.

The web heating controller 110 is configured to cause the panel driver assembly 120 of one or more of the radiant heating units to adjust the view factor in accordance with the detected temperature of the moving web. For example, if the detected temperature of the web is above the selected media heating temperature. The web heating controller 110 may generate signals to the panel driver assemblies 120 to cause a corresponding adjustment in the position of the panels from the current position toward the retracted position. In embodiments which incorporate a drive link which may be linearly driven by the panel driver assembly, the view factor adjustment may comprise a corresponding adjustment to the position of the drive link along the drive path.

The web heating system may further include a web speed/breakage detector 164. In the event of a web breakage, or if the speed of movement of the paper web falls below a predetermined value, the power supply to the heating panels may be interrupted and the panel driver assembly may be configured to move the panels to the retracted position inside the housing of the radiant heating units. The panel driver assembly may include a biasing member (not shown) such as a spring for biasing the drive link toward the back of the housing thereby biasing the panels toward the retracted position.

Those skilled in the art will recognize that numerous modifications can be made to the specific implementations described above. For example, although the web heating system has been depicted as for use with a solid ink jet printing system that prints onto a continuous media web, the web heating system may be utilized in substantially any type of printing system for heating the media web. The web heating system may also be useful in heating continuous webs of other materials such as thermoplastic web materials, textile webs, etc. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A solid ink imaging device comprising:

a continuous media web;

a media handling system configured to transport the continuous media web along a media pathway through the imaging device;

a solid ink printing system positioned along the media pathway, the solid ink printing system being configured to print images on the continuous media web;

a web heating system positioned along the media pathway at a location that enables the web heating system to heat the continuous media web after the solid ink printing system has printed an image on the continuous media web, the web heating system being configured to heat the continuous media web to a web heating temperature, the web heating system comprising:

at least one radiant heating unit positioned adjacent the media pathway, the at least one radiant heating unit including:

a housing adjacent to the media pathway;

a pair of radiant heating panels configured within the housing to emit thermal radiation in accordance with a variable thermal output signal, the pair of radiant heating panels being configured to be positioned selectively in the housing to any one of a plurality of positions between and including a fully open position in which the pair of radiant heating panels are positioned side by side in the opening of the housing to direct thermal radiation towards the continuous media web and a retracted position in which the pair of radiant heating panels are positioned inside the housing and facing each other, a view factor of the pair of radiant heating panels with respect to the continuous media web being different for each position in the plurality of positions; and a panel driver operatively connected to the pair of radiant heating panels to enable the pair of radiant heating panels to be positioned at least one of the plurality of positions in response to a variable view factor signal;

at least one temperature sensor configured to detect a temperature of the continuous media web and to generate a temperature signal indicative of the detected temperature of the continuous media web; and a web heating controller operatively connected to the panel driver and configured to generate selectively a thermal output signal and the variable view factor signal for operation of the panel driver to position at least one radiant heating unit to heat the continuous media web to the web heating temperature, the web heating controller being configured to generate at least one of the thermal output signals and the variable view factor signals in accordance with the temperature signal generated by the at least one temperature sensor.

2. The imaging device of claim 1, the at least one temperature sensor comprising a first temperature sensor configured to detect a temperature of the continuous media web at a position prior to the continuous media web reaching a plurality of radiant heating units and to generate a first temperature signal indicative of the detected temperature of the continuous media web before the continuous media web reaches the plurality of radiant heating units, and a second temperature sensor configured to detect a temperature of the media web at a position after the plurality of radiant heating units have heated the continuous media web and to generate a second temperature signal indicative of the detected temperature of the continuous media web after the continuous media web passes the plurality of radiant heating units.

3. The imaging device of claim 2, the web heating controller being configured to generate thermal output signals and variable view factor signals for at least one of the radiant heating units in accordance with the first and the second temperature signals.

4. The imaging device of claim 3, the web heating controller being configured to generate thermal output signals for the at least one of the radiant heating units to operate the at least one radiant heating unit and emit thermal radiation to heat the continuous media web to the web heating temperature; and the web heating controller being configured to generate at least one variable view factor signal to adjust the view factor of at least one radiant heating unit to compensate for deviations of the detected temperatures from the web heating temperature.

5. The imaging device of claim 1, the web heating controller being further configured to generate at least one variable view factor signal to adjust the view factor of the pair of radiant heating panels to compensate for deviations of at least one of the detected temperatures from an initial temperature.

6. The imaging device of claim 1, each radiant heating panel in the pair of radiant heating panels including at least one projection extending from at least one lateral side of a radiant heating panel; and the housing including guide grooves in positions on the housing corresponding to the at least one projection of each radiant heating panel in the pair of radiant heating panels, each one of the guide grooves being configured to receive the projection extending from a radiant heating panel to enable movement of the radiant heating panels to be guided between the fully open position and the retracted position.

7. The imaging device of claim 6, the housing including a drive link operatively connected to the radiant heating panels, the drive link being configured to enable linear movement of the drive link along a drive path and move the projections of the pair of radiant heating panels in the guide grooves to move the pair of radiant heating panels to a corresponding position in the plurality of positions.

8. The imaging device of claim 7, the panel driver being operatively connected to the drive link to move the drive link linearly along the drive path in accordance with the variable view factor signal.

9. The imaging device of claim 8, further comprising:

a position sensor configured to detect a linear position of the drive link with respect to the drive path and to generate a drive link position feedback signal that enables the web heating controller to detect the linear position of the drive link.

10. The imaging device of claim 9, further comprising:

a web speed detector configured to detect a speed of the continuous media web and to generate a web speed signal indicative of the speed of the continuous media web, the web heating controller being configured to reduce power to the radiant heating panels in response to the web speed signal being less than a threshold speed.

11. The imaging device of claim 1, the web heating system further comprising:

a plurality of radiant heating units positioned adjacent the media pathway.

12. The imaging device of claim 11, the at least one temperature sensor comprising a first temperature sensor configured to detect a temperature of the continuous media web at a position before the continuous media web reaches the plurality of radiant heating units and to generate a first temperature signal indicative of the detected temperature of the continuous media web before the continuous media web reaches the plurality of radiant heating units, and a second temperature sensor configured to detect a temperature of the continuous media web at a position after the continuous media web passes the plurality of radiant heating units and to generate a second temperature signal indicative of the detected temperature of the continuous media web after the continuous media web passes the plurality of radiant heating units.

13. The imaging device of claim 12, the web heating controller being configured to generate thermal output signals and variable view factor signals for at least one of the radiant heating units in accordance with the first and the second temperature signals.

14. The imaging device of claim 13, the web heating controller being configured to generate a thermal output signal for each radiant heating unit in the plurality of radiant heating units that operates each radiant heating unit to emit thermal radiation for heating the continuous media web to an initial temperature; and the web heating controller being configured to generate at least one variable view factor signal to adjust the view factor of at least one radiant heating unit to compensate for deviations of the detected temperature from the initial temperature.

15. The imaging device of claim 14, the housing of each radiant heating unit in the plurality of radiant heating units including guide grooves configured to interact with projections extending from at least one lateral side of each radiant heating panel to enable movement of the panels to be guided between the fully open position and the retracted position.

16. The imaging device of claim 15, the housing of each radiant heating unit in the plurality of radiant heating units including a drive link operatively connected to the radiant heating panels, the drive link being configured to move linearly along a drive path and move the projections of the radiant heating panels in the guide grooves to position the radiant heating panels in a pair of radiant heating panels at one of the positions in the plurality of positions.

17. The imaging device of claim 16, the panel driver of each radiant heating unit being operatively connected to the respective drive link to move the drive link linearly along the drive path in accordance with the variable view factor signal.

18. The imaging device of claim 17, each radiant heating unit in the plurality of radiant heating units including a position sensor configured to detect a linear position of the drive link with respect to the drive path and to generate a drive link position feedback signal to the web heating controller to indicate the linear position of the drive link.

* * * * *